US009205459B2

(12) United States Patent
Sauser

(10) Patent No.: US 9,205,459 B2
(45) Date of Patent: Dec. 8, 2015

(54) VIBRATING SCREEN DECK DEFLECTOR SYSTEMS AND METHODS

(71) Applicant: TEREX USA, LLC, Westport, CT (US)

(72) Inventor: Edwin J. Sauser, Monticello, IA (US)

(73) Assignee: TEREX USA, LLC, Westport, CT (US)

( * ) Notice: Subject to any disclaimer, the term of this patent is extended or adjusted under 35 U.S.C. 154(b) by 0 days.

(21) Appl. No.: 14/011,361

(22) Filed: Aug. 27, 2013

(65) Prior Publication Data

US 2014/0061102 A1 Mar. 6, 2014

Related U.S. Application Data

(60) Provisional application No. 61/693,819, filed on Aug. 28, 2012.

(51) Int. Cl.
*B07B 1/28* (2006.01)
*B07B 13/16* (2006.01)

(52) U.S. Cl.
CPC . *B07B 1/28* (2013.01); *B07B 13/16* (2013.01); *B07B 2201/04* (2013.01)

(58) Field of Classification Search
USPC ..... 209/311, 313, 315, 363
See application file for complete search history.

(56) References Cited

U.S. PATENT DOCUMENTS

| | | | | |
|---|---|---|---|---|
| 4,322,288 | A * | 3/1982 | Schmidt | 209/356 |
| 4,576,713 | A * | 3/1986 | Melin | 209/254 |
| 5,749,471 | A * | 5/1998 | Andersson | 209/314 |
| 6,889,846 | B2 * | 5/2005 | Olsen et al. | 209/404 |
| 7,971,817 | B1 * | 7/2011 | Rossi, Jr. | 241/101.74 |
| 8,636,150 | B1 * | 1/2014 | Akers et al. | 209/314 |
| 2013/0181075 | A1 * | 7/2013 | Pickens et al. | 241/14 |

* cited by examiner

*Primary Examiner* — Terrell Matthews
(74) *Attorney, Agent, or Firm* — Simmons Perrine Moyer Bergman PLC

(57) ABSTRACT

A material processing vibrating screen with diverting systems configured to deliver material, via a plurality of material diverters, to locations closer to a feed end of the screen than would otherwise be done in the absence of the diverters. The diverters can be fixed to a cross member, the underside of a screen, and may be adjustable and easily replaceable. The materials for the deflectors can vary depending upon the material being screened. The screen may be also be a variable sloped vibrating screen.

1 Claim, 2 Drawing Sheets

VIBRATING SCREEN DECK DEFLECTOR SYSTEMS AND METHODS

CROSS REFERENCE TO RELATED APPLICATIONS

This application claims the benefit of the filing date of the provisional patent application having Ser. No. 61/693,819 filed Aug. 28, 2012.

The contents of this application are incorporated herein in its entirety by these references.

BACKGROUND OF THE INVENTION

This invention relates to vibrating screens.

The aggregate industry utilizes many styles of screen machines to sort aggregates by size. Most screen machines utilize vibration to agitate the mixture of aggregates to promote separation through various sized openings in the screening surfaces. Sorting is achieved by undersized particles passing through the openings in the screening surface and the oversized particles being retained above the screen surface. These machines usually have some type of vibrating mechanism to shake the unit and its screening surfaces. The vibrating mechanisms usually include an unbalanced weight mounted on one, or several, rotating shafts which, when rotated, force a cycling motion into the screen machine.

Sometimes a screen is designed with several layers, or decks, of screening surfaces which have screen media of various sized openings to allow sorting of granular material, which is fed into the machine, into several discreet particle sizes. These layers may be herein referred to as decks or screens.

The screen surface media normally consists of a wire mesh or flexible panel with punched or formed holes, all which have specific sized openings to allow passage of sized particles to the decks below, or out the bottom of the screen. The larger sized particles are retained above the surface and are usually discharged on the end opposite the feed end of the deck.

The screen media is normally sized with larger holes in the upper decks and smaller holes in the lower decks. A mixture of granular material, comprised of a variety of sized particles, is fed onto the top deck, which normally has the largest holes. Material smaller than the holes then falls through to the next level, while the material larger than the holes is retained on the deck. The material that has fallen through the holes settles onto the next lower deck. The next lower deck normally has smaller holes than the deck directly above. The material that is smaller than the hole falls through this deck while the material larger than the hole is retained, thus leaving a very specific size of material on this deck, smaller than the deck holes above, larger than the deck holes below. This is then repeated on lower decks depending on how many decks are employed in the screen machine. There can be many deck levels depending on how many different sized materials are desired from the machine.

For a continuous screening machine, the motion of the screen normally propels the material from one end of the screen known as the feed end, toward the opposite end known as the discharge end. Material can be continuously fed onto the feed end of the top most deck and as it flows across and down through the decks, various sized material are ejected from the discharge end of each sizing deck.

As the material travels down the decks, and until the undersized material (smaller than the holes) falls through the holes, there is some lag time until the particles can align and fall through the holes. The lag time before material starts hitting the lower deck reduces the effective screening surface of the lower deck. The industry normally assumes a lag time effect, i.e. an approximate reduction of 10% of the screening surface per deck level when computing the theoretical capacity of passing material through a deck. For example, if a top deck is 4' wide and 10' long from feed end to discharge end, the effective size is $4\times10=40$ square feet of screen surface on that deck. The next lower deck, assuming 10% reduction attributable to the lag time effect, the effective screen surface on this deck is $(1-0.1)\times4\times10=36$ square feet. Again, for a third deck, the effective screen area is $(1-0.1-0.1)\times4\times10=32$ square feet.

Consequently, there is a need for improvement in sorting systems for multi-deck vibrating screens.

SUMMARY OF THE INVENTION

More specifically, an object of the invention is to provide an effective vibrating screen for use multiple decks.

It is a feature of the present invention to include a deflector located between decks of a multiple deck screen.

It is an advantage of the present invention to reduce amount of the lag time effect.

It is another feature of the present invention to multiple deflectors attached to the underside of a single screen.

It is another advantage of the present invention to increase the uniformity of material depth across the lower screen.

It is still another feature of the present invention to include adjustable deflectors in both length and angular orientation.

It is still another advantage of the present invention to selectively determine the amount of material to be diverted by adjusting the deflector.

The present invention includes the above-described features and achieves the aforementioned objects.

Accordingly, the present invention comprises a vibrating screen with a material deflector attached below one screen and above another screen, for carrying the material closer to a feed end of the screen.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
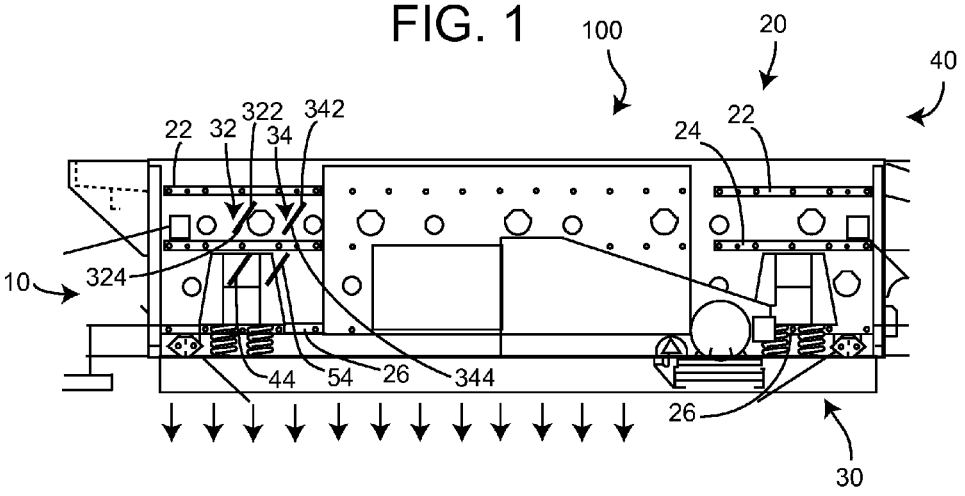
FIG. 1 is an elevation view of a material processing system of the present invention.

Now referring to the drawings wherein like numerals refer to like matter throughout, and more specifically referring to FIG. 1, there is shown an elevation view of a material processing system of the present invention, generally designated 100, which has a feed end 10, top side 20, bottom side 30 and discharge end 40. The multi-deck screen 100 is shown in a horizontal orientation. It should be understood that the present invention is not limited to horizontal screens and indeed some of the beneficial aspects of the invention are especially helpful when the screen 100 is inclined. The mechanism for inclining the screen is well known in the prior art. Inside of screen 100 is top screen 22, middle screen 24 and bottom screen 26. The screen 100 is shown with side panels at the feed end 10 and the discharge end 40 removed so as to reveal the inner structures. Top screen 22 is shown with two diverters 32 and 34 attached thereto. In some embodiments, these might be considered optional and might be removed. These diverters 32 and 34 are shown as being optionally adjustable in length via overlapping or telescoping sections 322, 324 and 342, 344 respectively. The adjustable nature of the diverters is especially helpful when the screen 100 is a variable slope screen which is readily varied. These could pivot below the top screen 22. These angular and length adjustable diverters might bear some general resemblance to the flaps on an aircraft wing and might employ some manual mechanical or automated electronic or hydraulic remote controlled mechanism for making the adjustments. Automation of diverter adjustment which is dependent upon a variable screen slope orientation may be helpful in some applications.

Diverters 44 and 54 are shown disposed beneath the middle screen 24 and are shown as fixed in length and orientations. It should be understood that these diverters also could be adjustable in angular orientation and length similar to diverters 32 and 34.

Figure 2:
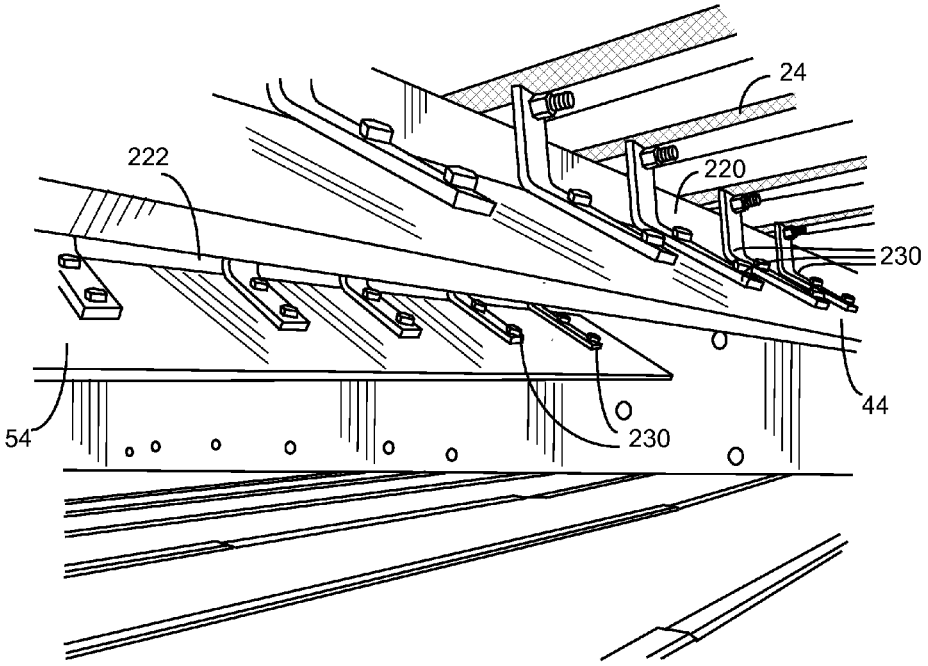
FIG. 2 is a perspective internal view of the system of FIG. 1 looking from the feed end toward the discharge end.

Now referring to FIG. 2, there is shown a view of an insider portion of the screen 100 of FIG. 1 looking from the feed end 10 in a direction toward the discharge end 40. There is shown a cross support beam 220 and a second cross support beam 222. These beams support angled brackets 230, which help to hold the diverters 44 and 54 respectively below the middle screen 24 and bottom screen 26. The curved arrows in FIG. 2 represent the direction of flow of material.

The lag time effect can be reduced or eliminated by employing the system of deflectors, 32, 34, 44, and 54.

A thinner bed depth reduces the carry of small material on the bed of material, allowing it to contact the screening surface sooner, which improves the efficiency of that deck.

Figure 3:
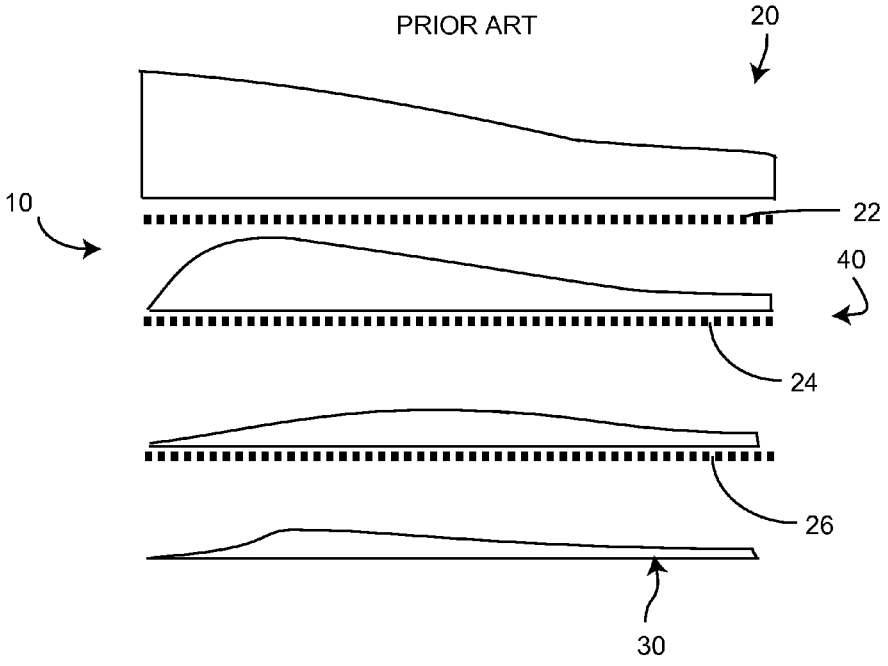
FIG. 3 PRIOR ART
FIG. 3 is a graphic view of a material depth characteristic of a prior art screen.

FIG. 3 shows normal material distribution on a prior art 3 deck screen.

Figure 4:
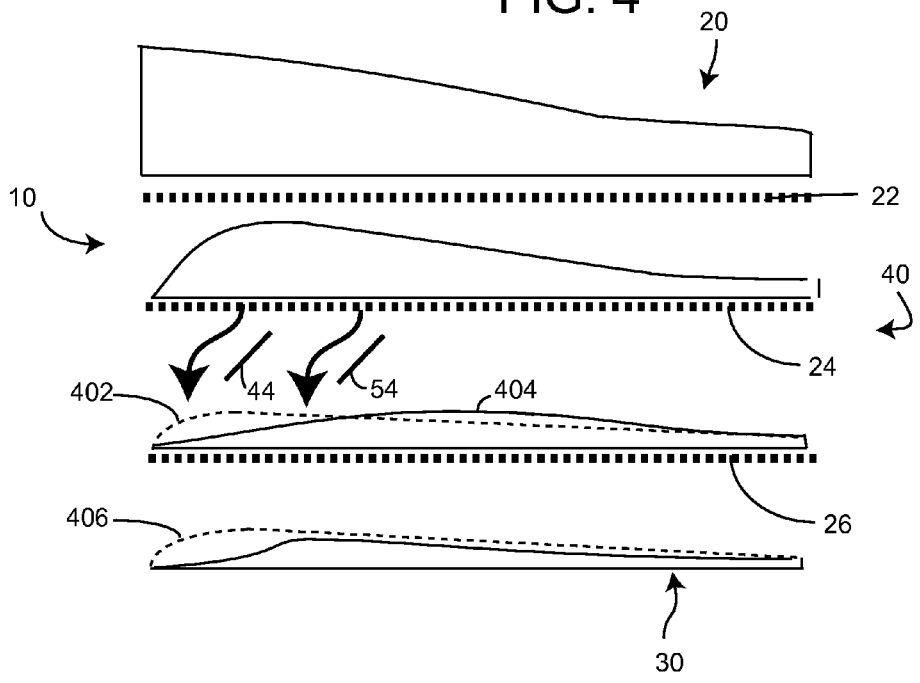
FIG. 4 is a graphic view of a material depth characteristic of a screen of the present invention and system and configuration as shown in FIGS. 1 and 2, where the dotted lines refer to the material depth of FIG. 3.

FIG. 4 shows the difference using the deck deflectors 44 and 54 to divert the material toward the feed end of the lower deck 26. Dotted material depth lines in FIG. 4 are the same as the solid material depth lines in FIG. 3. This helps to show the positive aspects of the present invention. Area 402 is material which has been shifted forward or toward the feed end 10 and the gap in the middle and section between the dotted and solid material depth lines represents the reduction in maximum bed depth. The area 406 shows the increased material at the feed end 10.

By using the diverters 32, 34, 44, and 54 the effective surface area of the lower screens is increased. This allows for one or more of increased efficiency of operation, more precise control of homogeneity of material being output at the discharge ends of each of the lower decks (fewer particles in a discharge end of a screen which are smaller than that screen size).

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A multi-deck vibrating screen comprising:

an upper deck;

a lower deck;

flow diverting means disposed between said upper deck and said lower deck, configured to reduce an amount of fines material that passes through both said upper deck and said lower deck in a substantially vertical manner;

an intermediate deck disposed between said upper deck and said lower deck in a substantially parallel configuration and said flow diverting means being disposed between said upper deck and said intermediate deck;

a lower material deflector disposed between said intermediate deck and said lower deck and configured to divert material which was previously diverted by said flow diverting means; and wherein said flow diverting means is an upper material deflector coupled below said upper deck;

wherein said upper material deflector is rigidly coupled to a cross member spanning the intermediate deck.

* * * * *